United States Patent [19]

Hart

[11] Patent Number: 4,594,864

[45] Date of Patent: Jun. 17, 1986

[54] LOCKSET ASSEMBLY

[75] Inventor: Leroy Hart, Farmington, Conn.

[73] Assignee: Emhart Industries, Inc., Farmington, Conn.

[21] Appl. No.: 537,896

[22] Filed: Sep. 30, 1983

[51] Int. Cl.[4] ..... E05B 55/06

[52] U.S. Cl. ..... 70/143; 70/474; 70/476; 70/479; 70/489; 292/167; 292/169.15

[58] Field of Search ..... 70/129, 143, 145, 151 A, 70/463, 464, 471, 472, 474–485, 489; 292/139, 167, 169.13–169.19, 337, 357, DIG. 38, DIG. 56, DIG. 73

[56] References Cited

U.S. PATENT DOCUMENTS

| | | | |
|---|---|---|---|
| 2,694,918 | 11/1954 | Welch | 70/480 X |
| 2,996,326 | 8/1961 | Schlage | 292/337 |
| 3,036,850 | 5/1962 | Schmid | 292/167 X |
| 3,241,874 | 3/1966 | Russell et al. | 292/357 |
| 3,279,836 | 10/1966 | Swanson | 292/337 X |
| 4,031,725 | 6/1977 | Reid | 292/169.13 X |
| 4,193,619 | 3/1980 | Serka | 292/DIG. 38 X |
| 4,333,324 | 6/1982 | Dietrich et al. | 70/472 X |

*Primary Examiner*—Robert L. Wolfe
*Assistant Examiner*—Russell W. Illich
*Attorney, Agent, or Firm*—Barry E. Deutsch

[57] ABSTRACT

A lockset assembly which includes a bolt (12) movable between a partially extended latching position and a fully extended dead bolt position. When the bolt (12) is in the dead bolt position, the inside lever (10) can be used to retract the bolt. The outside operating assembly (27) is provided with a key operated lock cylinder (22) and the inside operating assembly (44) is provided with a turn button (26).

18 Claims, 25 Drawing Figures

LOCKSET ASSEMBLY

BACKGROUND OF THE INVENTION

This invention relates in general to a lockset and more particularly to a lockset assembly in which the latch bolt is extendable into a dead bolt function.

With the usual latch bolt type lockset, the bolt extends about one-half inch from the front of the lock. Taking into consideration the gap that exists between the door jamb and the door, even less of the length of the latch bolt is available for engagement with the door jamb. Accordingly, with this type of lock, one possible way of obtaining unlawful entry is to spread the door jamb further away from the door to have the latch bolt clear the strike and the lock will no longer serve to maintain the door closed.

In view of the above, it has become increasingly popular to add an auxiliary dead bolt lock to the door. However, the use of such an auxiliary dead bolt does present some problems. For example, its use requires a second hole to be drilled in the door as well as requiring the mounting of an additional mechanism. Also it may require the use of a separate key if the latch bolt cylinder and the auxiliary dead bolt cylinder are not keyed alike. In addition, the latch bolt mechanisms as well as the auxiliary dead bolt are normally capable of being locked on the inside. In an emergency situation, it would take two actions by the person in the inside to retract the latch bolt and auxiliary dead bolt to open the door and have egress therefrom.

SUMMARY OF THE INVENTION

In view of the above, it is an object of the present invention to provide an improved lockset assembly which functions both as a latch bolt and a dead bolt.

More specifically, it is an object of the present invention to provide a lockset assembly in which the latch bolt is extendable into a dead bolt position.

Yet another object of the present invention is to provide a lockset assembly in which the latch bolt is movable from a latching position into a dead bolt position and in which a panic release from the inside of the door is provided whereby the bolt can be released or retracted from its dead bolt position merely by turning the hand operated mechanism.

Another object of the present invention is the provision of a lockset including a lock front which can be mounted on a door having either a beveled or flat front surface.

Still another object of the present invention is the provision of a lockset assembly which is able to compensate for differences in door thicknesses.

A further object of the present invention is the provision of a latch bolt assembly which is provided with a wear strip to provide relatively more durable action.

These and other objects of the present invention may be accomplished by the provision of the lockset to be described below.

DETAILED DESCRIPTION

Figure 24:
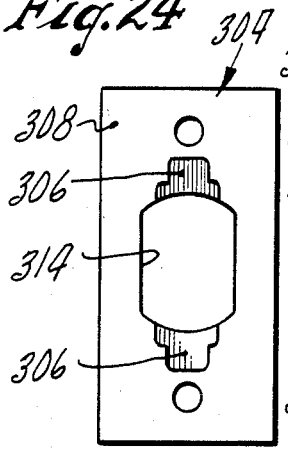
FIG. 24 is a view showing the inside of the front plate looking outwardly therefrom from within the door.
Figure 23:
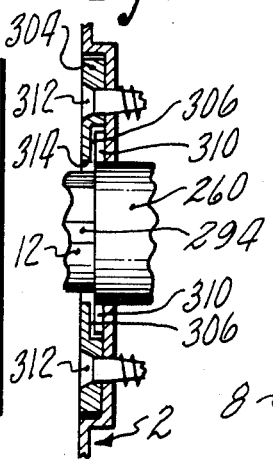
FIG. 23 is a vertical cross-sectional view showing the connection of the front of the lock with respect to a metal door.
Figure 1:
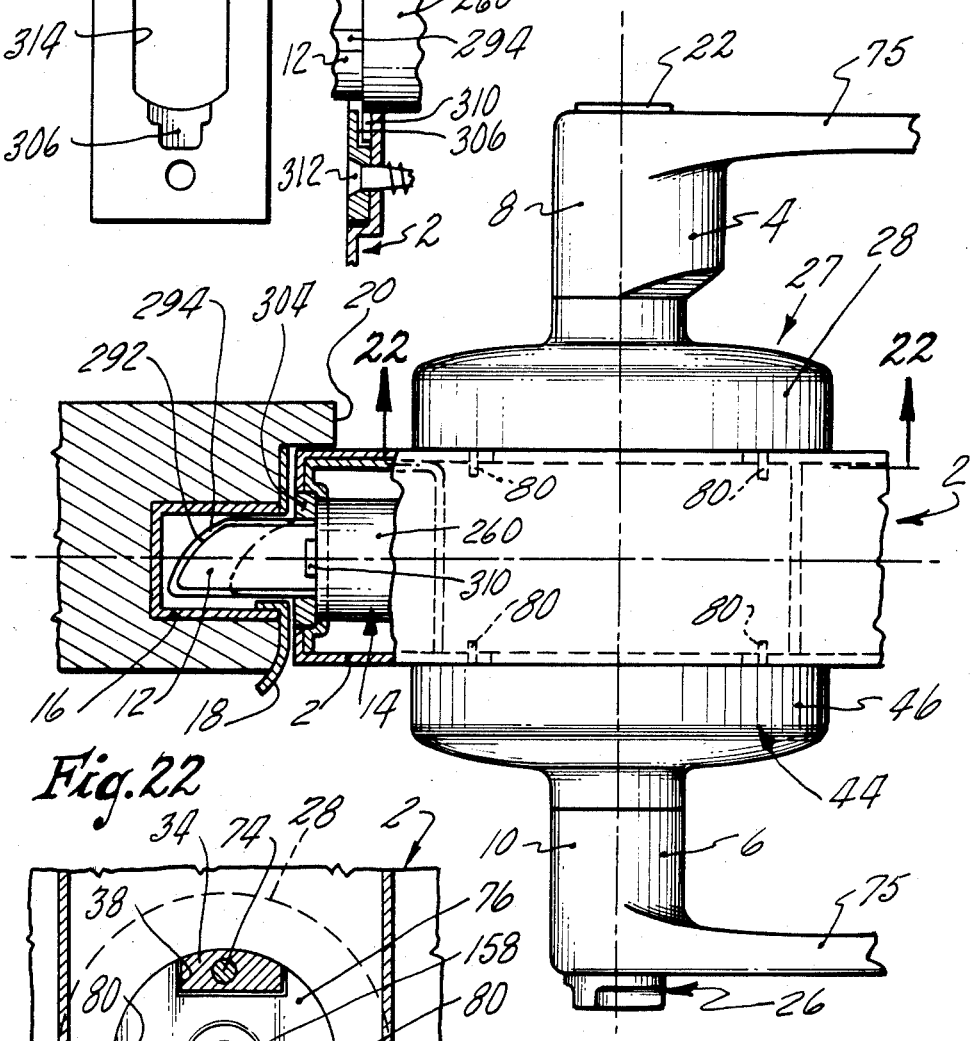
FIG. 1 is a plan view looking down upon the lockset assembly showing it mounted within the door and its association with the door jamb.

Referring to the drawings and in particular FIG. 1, the lockset mechanism 1 of the present invention is shown mounted in a door 2 and includes an outside hand operated member 4 and an inside hand operated member 6 which in the preferred embodiment are an outside lever 8 and an inside lever 10. The outside and inside levers 8 and 10 are used to retract a latch bolt 12 of the latch bolt assembly 14 of the lockset mechanism from a strike box 16 and strike plate 18 mounted on the door jamb 20 in conventional fashion. According to the embodiment shown herein, the outside operating assembly 27 of the lockset may be provided with a key operated lock cylinder 22 mounted within the outside lever 8 and the inside operating assembly 44 of the lockset may be provided with a turn button 26 mounted within the inside lever 10. The lock cylinder 22 and turn button 26 may be used to move the latch bolt 12 between its extended dead bolt position shown in full lines in FIG. 1 and its latching position shown by the dotted lines in FIG. 1.

Figure 2:
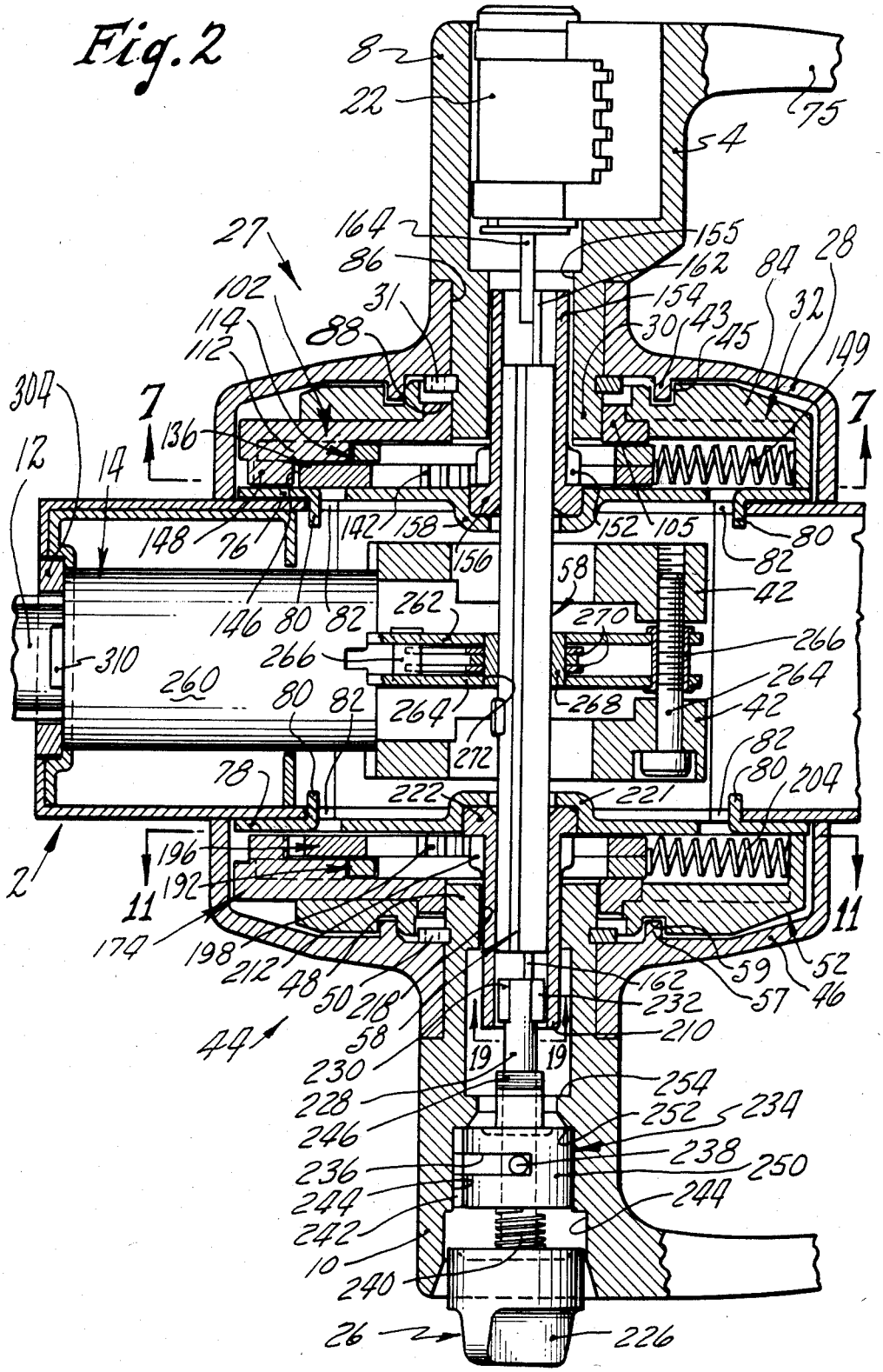
FIG. 2 is a horizontal sectional view taken along the horizontal axis of the lockset showing the lockset mounted within a metal door frame.
Figure 3:
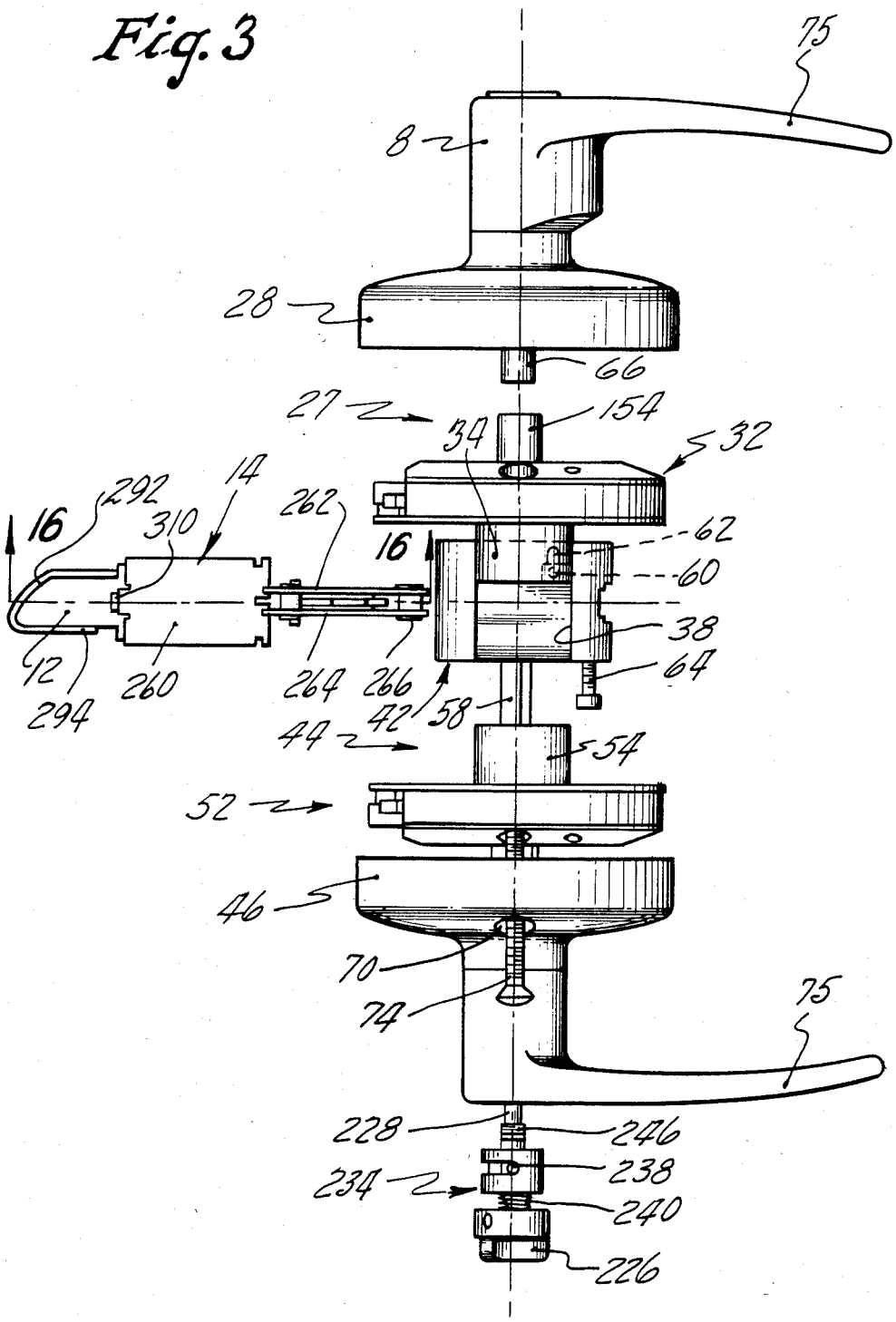
FIG. 3 is a horizontal exploded plan view showing the various subassemblies of the lockset of the present invention.
Figure 4:
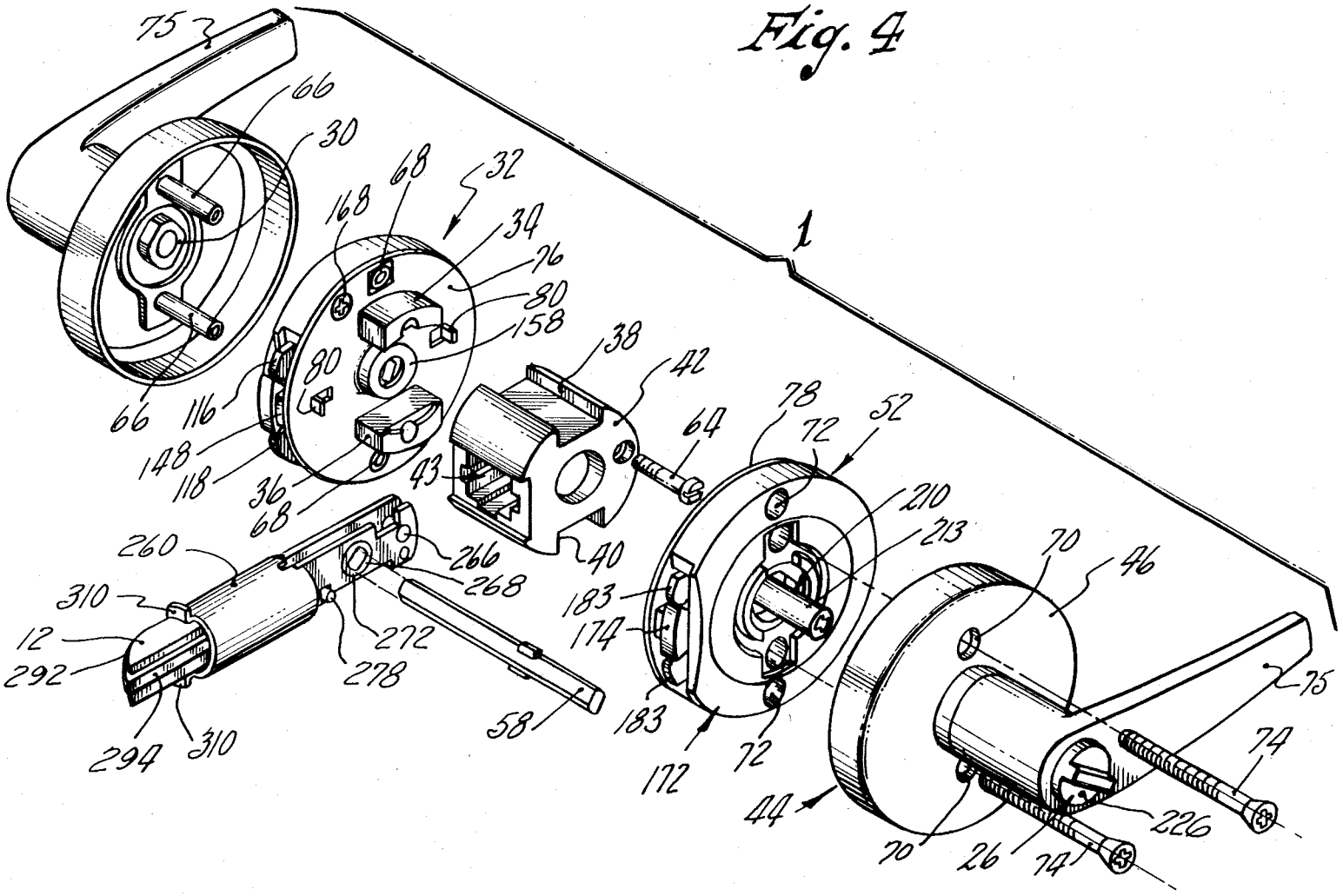
FIG. 4 is a perspective exploded view showing the various subassemblies of the lockset of the present invention.

Referring now to FIGS. 2, 3, and 4, the outside operating assembly 27 includes the outside lever 8 which is rotatably mounted within an outside rose 28 and includes a generally square-shaped projection 30 extending into the outside rose 28 and is held in place for rotational motion with respect thereto by a retaining ring 31. Positioned within the outside rose 28 is an outside operating cassette 32 having upper and lower ear-like projections 34 and 36 respectively extending therefrom which fit into suitable grooves 38 and 40 respectively on the outer surface of a latch bolt assembly holder 42 which is positioned within the door 2. A generally circular raised portion 47 is provided on the inside surface of the outside rose 28 which extends into a mating circular groove 45 in the outside surface of the outside operating cassette 32 to provide radial alignment of the two members. The latch bolt assembly holder 42 provides a mechanism for mounting the latch bolt assembly 14 which contains the latch bolt 12 and includes a suitable slot 43 into which the latch bolt assembly 14 may be inserted.

In a similar manner, an inside operating assembly 44 includes the inside lever 10 which is pivotally mounted within an inside rose 46 and includes a generally square-shaped projection 48 extending thereinto and which has a retaining ring 50 attached thereto so that the inside lever 10 is mounted for relative rotation with respect to the inside rose 46 in a like manner as the outside operating assembly 27. An inside operating cassette 52 is mounted within the inside rose 46 and includes upper and lower ear-like projections 54 and 56 respectively which extend into the grooves 38 and 40 on the latch bolt assembly holder 42. A generally circular raised portion 57 is provided on the inside surface of the inside rose 46 which extends into a mating circular groove 59 in the outside surface of the inside operating cassette to provide radial alignment of the two members. A spindle 58 extends through the latch bolt assembly 14 and between the inside and outside operating cassettes 32 and 52 in a direction perpendicular to the axis of movement of the latch bolt 12.

Before going into the details of the respective inside and outside operating assemblies 27 and 44 as well as the latch bolt assembly 14, the basic assembly of the lockset within the door 2 will be described. Assuming that the lockset 1 is to be mounted on a metal door 2, such as shown in FIGS. 1 and 2, and that the proper openings have been provided in the door, the lockset 1 of the present invention may be mounted as follows. It should be noted that although the lockset 1 of the present invention is shown mounted in a left-handed door 2, it is applicable to doors of any configuration.

The outside operating cassette 32 is mounted on the latch bolt assembly holder 42 with the projections 34 and 36 received within the grooves 38 and 40 respectively of the holder 42. A roll pin 60 extends through the lower projection 36 into slot 62 formed in the bottom of the groove 40. This permits the outside operating cassette 32 to have limited relative movement with respect to the latch bolt assembly holder 42 while maintaining the outside operating cassette 32 and the latch bolt holder 42 together as a subassembly. With the outside operating cassette 32 positioned against the surface outside of the door 2 and the latch bolt assembly holder 42 positioned within the frame of the door 2, the latch bolt assembly 14 may be inserted into the latch bolt assembly holder 42 and secured thereto by means of a screw 64. After the spindle 58 is inserted through the latch bolt assembly 14, the inside operating cassette 52 is positioned on the inside surface of the door 2 with its projections 54 and 56 extending into the grooves 38 and 40 on the latch bolt assembly holder 42.

The outside rose 28 to which the outside lever 8 is attached includes upper and lower internally threaded posts 66 extending in a direction perpendicular to the axis of movement of the latch bolt assembly 14. When the outside rose 28 is mounted over the outside operating cassette 22, the posts 66 extend into openings 68 in the outside operating cassette 32. The inside rose 46 has upper and lower openings 70 therein which align with openings 72 in the inside operating cassette 52 when the inside rose 46 is mounted thereon. Screw members 74 extend through the openings 70, 72 in the inside rose 42 and the inside operating cassette 48 into threaded engagement with the posts 66 on the outside rose 28.

As it is typical in the art, the lever portion 75 of each of the lever handles 8 and 10 extend horizontally in a direction opposite to the extension of the latch bolt 12. As the inside and outside operating cassettes 32 and 52 are moveable relative to the latch bolt assembly holder 42 in a direction perpendicular to the axis of the latch bolt assembly 14, the lockset 1 will mount properly on doors regardless of variations in door thicknesses. It should also be noted that the latch bolt assembly 14 is positively mounted with the latch bolt assembly holder 42 by means of the screw 64 and also the inside and outside operating cassettes 32 and 52 are held in proper alignment with the latch bolt assembly holder 42 by means of the projections 32, 36 and 54 and 56 mating with the grooves 38 and 40 in the latch bolt assembly holder 42. This helps insure proper alignment of the various components for insertion of the spindle 58.

Figure 22:
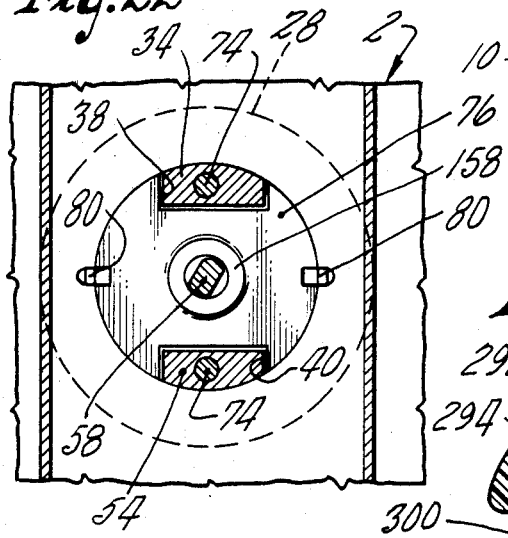
FIG. 22 is a view taken along the lines 22—22 of FIG. 1 showing the mounting of the lock within a metal door frame.

Referring to FIGS. 2 and 22, the inside operating cassette 52 includes a cover 78 and outside operating cassette 32 includes a cover 76 both of which are provided with two spaced tabs members 80 extend inwardly therefrom into engagement with a mating slot 82 in the metal frame of the door 2 adjacent the opening therein. The engagement of the tab 80 with the slots 82 help prevent the roses 28 and 46 and the inside and outside operating cassettes 52 and 32 from rotating relative to the door.

Figure 5:
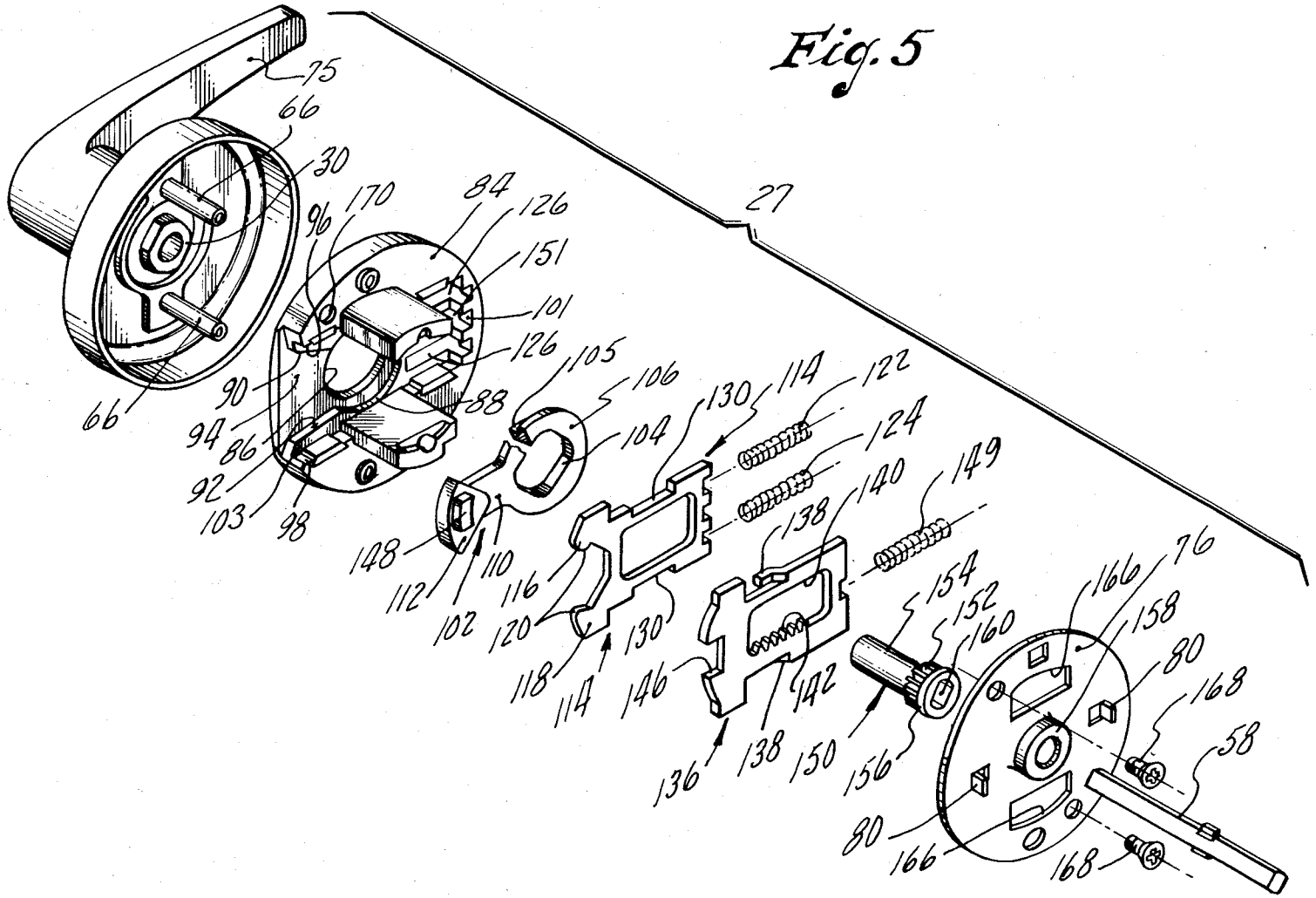
FIG. 5 is a perspective exploded view of the outside actuating assembly of the lockset of the present invention.

Referring now to FIGS. 2 and 5, the outside operating cassette 32 includes a housing 84 which has a central opening 86 into which the projection 30 of the outside lever 8 extends. The inside of the housing 84 includes a counterbore 88 concentric with the opening 86 and spaced wall portions 90 and 92 extending forwardly from the counterbore 88 in the direction of the extension of the latch bolt 14. The wall portions 90 and 92 taper outwardly and away from each other forming a V-shaped outer guideway 94. The inside surface of the housing 84 is also formed with a second set of opposed wall portions 96 and 98 spaced axially inwardly of said wall portions 90 and 92. The forward portion of the wall portions 96 and 98 are spaced apart a greater distance than the rearward portions forming upper and lower stop shoulders 100. A rear wall portion 101 closes the end of the inner guideway 103 formed by the wall portions 96 and 98.

An actuating member 102 is mounted in the inner guideway 94 with a boss 105 thereof mounted in the opening 86 in the housing 84 and includes a generally squared-shaped opening 104 into which extends the generally square-shaped projection 30 of the outside lever 8. The actuating member 102 includes a base portion 106 and a reduced elongated tail portion 110 which extends from the base portion 106 and is positioned within the V-shaped guideway 94. The forward end of the tail portion 110 is provided with a raised V-shaped cam surface 112 extending inwardly past the plane of the inner surface of the tail portion 110.

A spring plate 114 is mounted within the housing 84 of the outside operating cassette 32 in the guideway 104 in overlapping relationship with the actuating member 102. At its forward end the spring plate 114 includes two spaced fingers 116 and 118 each having a cam follower surface 120 thereon adapted to be engaged by the V-shaped cam surface 112 on the actuator member 102. The spring plate is biased forwardly in the direction of extension of the latch bolt 14 into engagement with the cam surface 112 on the actuating member 102 by means of two lever springs 122 and 124 each of which is positioned in a suitable groove 126 provided in the housing 84 and extends from the rear wall portion 101 to the rearward end 128 of the spring plate 114.

The spring plate 114 has a cutout portion 130 in both its upper and lower side edges which form tab engaging surfaces 132. The side edges ride between the wall portions 96 and 98 with the forward end of the spring plate 114 being wider than the rearward end. The shoulders 134 formed between the wider forward portion and narrow rearward portion of the spring plate 114 form stop surfaces 135 for abutting the stop shoulders 100 formed in the housing 84.

A generally flat rack plate 136 is mounted within the housing 84 in the guideway 103 in overlapping relationship with the spring plate 114. The upper and lower edges of the rack plate 136 have outward extending tab portions 138 extending outward into the cutout portions 130 in the spring plate 114 in a position to be engaged by the tab engaging surfaces 132 provided on the spring plate 114. The rack plate 136 also has a generally rectangular internal cutout 140, with the longer sides extending parallel to the axis of the latch bolt assembly 14. Gear teeth 142 are provided on the rack plate 136 adjacent one of the longer sides of the cutout 140 forming a rack which extends parallel to axis of the latch bolt assembly 14. Similar to the spring plate 114, the rack plate 136 is wider at its forward end, thus forming at its rearward end stop shoulders 144 adapted to abut the stop shoulder 100 formed in the housing 84. The forward end of the rack is provided with a notch 146 into which extends a lug portion 148 extending inwardly from the forward end of the actuating member 102 when the rack member is in its forward position shown in FIG. 7 to prevent rotation of the actuating member 102. The rack plate 136 is biased into its forward position by a spring member 149 positioned in suitable groove 151 in the housing 84 and extending between the rear wall portion 102 of the housing 84 and the rearward end 153 of the rack plate 136.

A pinion member 150 extends perpendicular to the axis of the latch bolt assembly 14 and is mounted within the outer operating cassette 32 and includes a set of gear teeth 152 which are in mating engagement with the gear teeth 142 on the rack plate 136. The pinion member 150 also includes a tubular extension portion 154 which extends through the spring plate 114, actuating member 102, and housing 84 into an opening 155 in the outside lever 8.

The pinion member 150 includes a head portion 156 which is contained within the inside of a boss 158 which extends inwardly on the cover member 76 which provides a bearing surface for the head portion 156. The head portion 156 of the pinion member 150 has a generally rectangular slot 160 therein of a mating cross-section with that of the spindle 58 which extends therethrough. The tubular extension portion 154 includes opposed ribs 162 therein which are engagable by a drive member 164 connected to the lock cylinder 22 in the outside lever 8 to rotate the pinion member 150 between its unlocked dead bolt positions.

In accordance with the above described arrangement, the actuating member 102 has pivotable movement about the axis of the spindle 58 and is operably attached to the outside lever 8. The spring plate 114 and rack plate 136 are mounted within the housing 84 for rectilinear motion in a direction parallel to the motion of the latch bolt 12 of the latch bolt assembly 14. To provide for a smooth action, the wall portions 96 and 98 of the housing 84 include wear pads 165 inserted therein which guide the spring plate 114 and rack plate 136 as shown in particularly in FIGS. 7 and 8. The wear pads 165 may be fabricated from a suitable antifriction material such as Delrin which is a polyocetal.

The cover member 76 for the outside operating cassette 36 is provided with suitable cutout portions 166 through which the projections 34 and 36 extend to contain the operative parts of the operating housing as a unit. The cover member 76 is attached to the housing 84 by means of screws 168 extending through the cover member 76 into threaded bores 170 within the housing 84.

Figure 6:
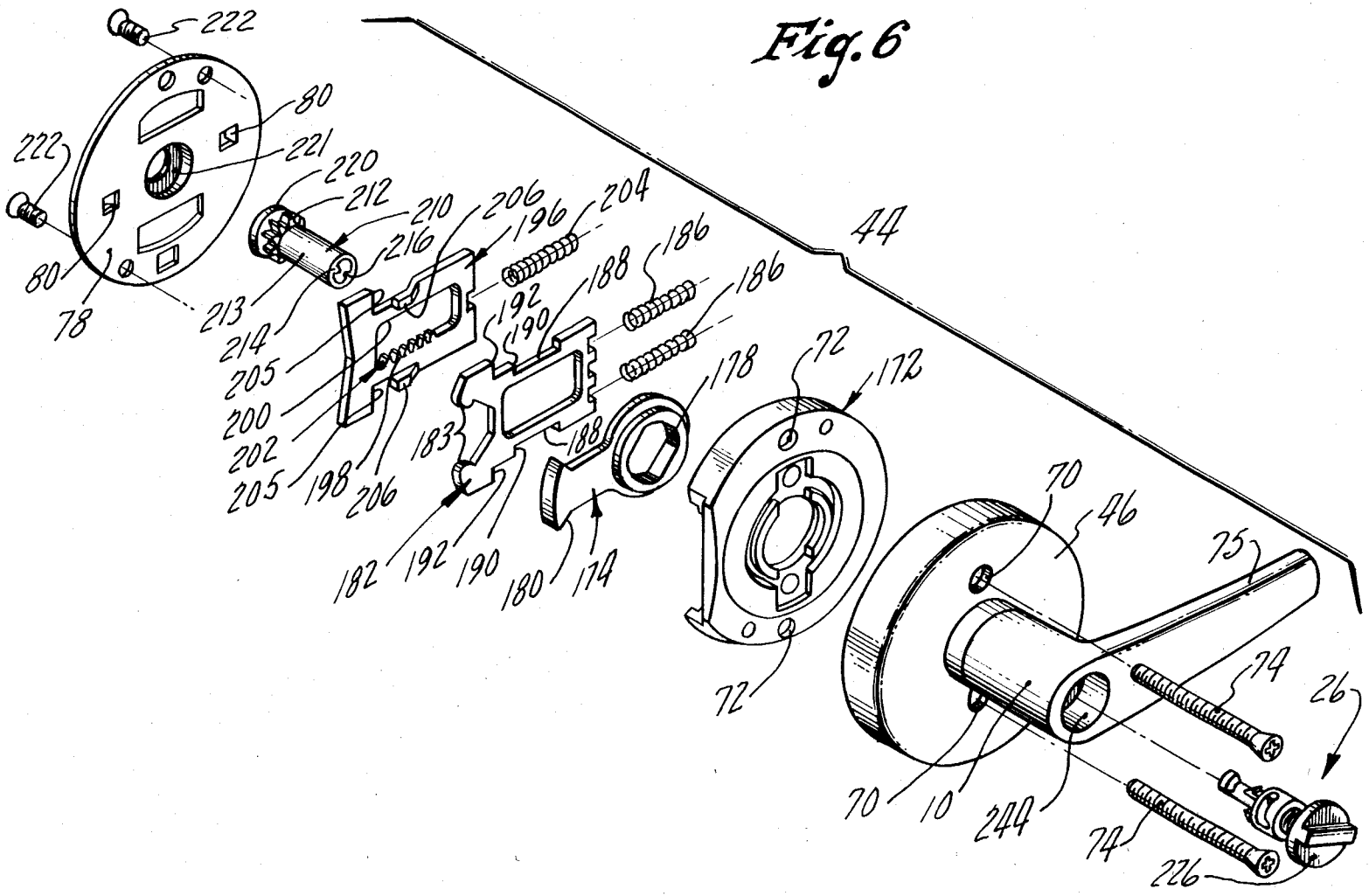
FIG. 6 is a perspective exploded view of the inside actuating assembly of the lockset of the present invention.

Referring to FIGS. 2 and 6 in particularly, the inside operating assembly 44 includes the inside rose 46 and the inside lever 10 attached thereto in a similar manner as the outside operating assembly by a retaining ring 50. The inside operating cassette 32 includes basically the same elements and is constructed similar to that of the outside operating cassette 84 which has been described above. Accordingly, the description of the various components of the inside operating cassette 52 will be relatively brief except for the differences between it and the outside operating cassette 32 which will be pointed out in more explicit detail below.

The inside operating cassette 52 includes an inside housing 172 having the projections 54 and 56 extending therefrom and in which is mounted for pivotal movement, an inside actuating member 174 in a guideway 176 similar to that described above in connection with the outside actuating member 102. The inside actuating member 174 includes a central generally square-shaped opening 178 into which the square-shaped projection 48 of the inside lever 10 projects as well as a raised V-shaped cam portion 180. A spring plate 182 having cam surfaces 183 for engagement with the cam surface 180 on the actuating member 174 is mounted in a guideway 184 in the inside housing 172. As in the case of the outside operating mechanism, the spring plate 182 is spring biased forwardly by spring members 186. The spring plate 182 also includes a cutout portion 188 in each of its side edges forming a tab engaging surfaces 190 and stop shoulders 192 adapted to engage a stop shoulders 194 in the housing 172.

A rack plate 196 having gear teeth 198 provided adjacent a rectangular cutout 200 forming a rack 202 is mounted in the guideway 184 overlapping the spring plate 182. The rack plate 196 is spring biased forwardly by a spring member 204. The rack plate 196, also includes stop shoulders 205 adapted to engage the stop shoulder 194 in the housing 172 and outwardly extending tabs 206 extending into the cutout portions 188 in a position to be engaged by the tab engaging portions 190 of the spring plate 182.

Figure 11:
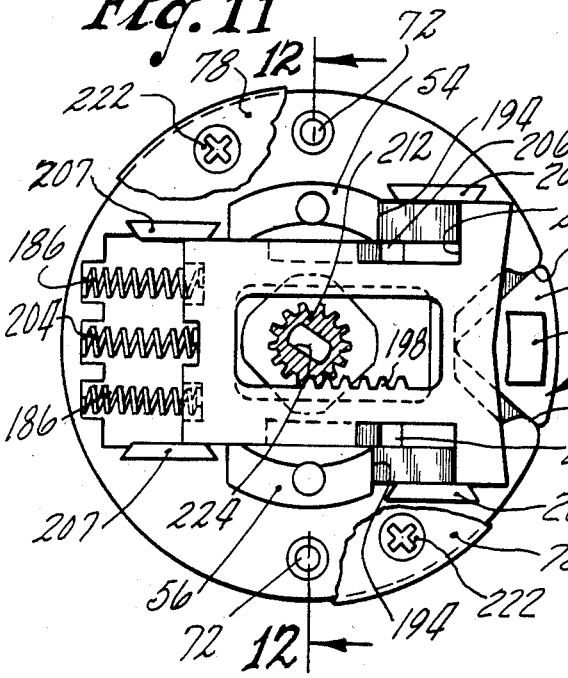
FIG. 11 is a view taken along the lines 11—11 of FIG. 2 with the rose removed and showing the positions of the components of the elements of the inside cassette when the lockset is in its dead bolt position.
Figure 12:
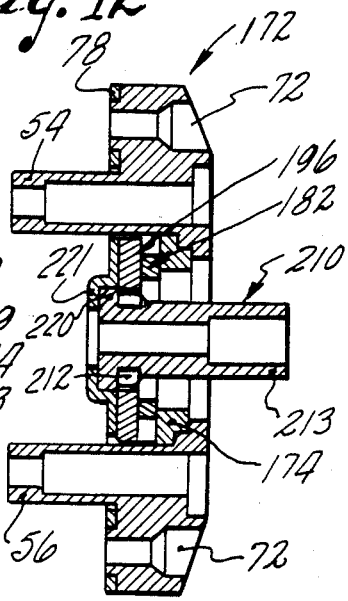
FIG. 12 is a transverse sectional view taken along the lines 12—12 of FIG. 11.
Figure 13:
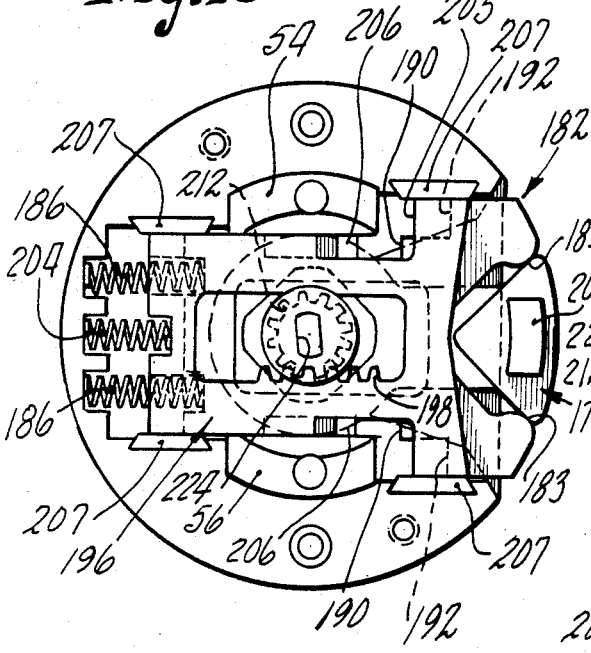
FIG. 13 is a view similar to FIG. 11 but showing the components of the inside operating cassette when the latch bolt is in the latching position.
Figure 14:
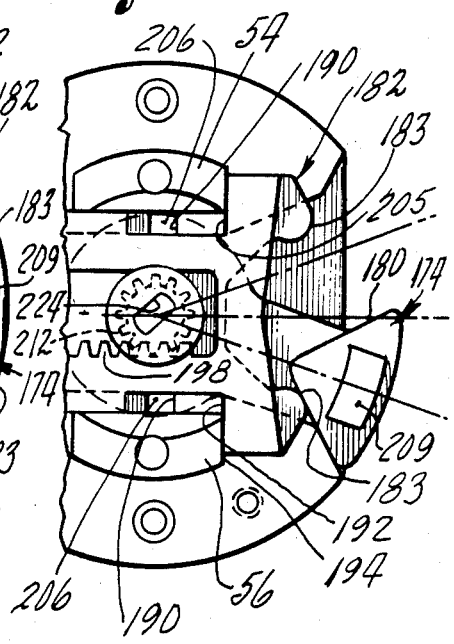
FIG. 14 is a view similar to that of FIG. 11 but showing the position of the components of the inside operating cassette when the latch bolt has been retracted into its open or retracted position by the hand operated mechanism.

The guideway 184 also includes wear inserts 207 of the same type as described in connection above in connection with the outside housing 84. However, in contrast to the rack plate 136 of the outside operating assembly 27, the forward end of the rack plate 196 of the inside operating assembly 44 is foreshortened and does not include a notch so that when it is in its forward dead bolt position as shown in FIG. 11 and the tabs 206 are in engagement with the tab engaging surfaces 190 of the spring plate, the forward end does not come into engagement with the lug portion 209 on the actuating member 174. As a result, the actuating member 174 is free to pivot when the rack plate 196 is in its forward dead bolt position.

A pinion member 210 includes gear teeth 212 thereon in mating engagement with the teeth 198 on the rack plate 196. The pinion member 210 includes a tubular extension 213 having opposed ribs 214, 216 therein which extend through the inside operating cassette 52 into an opening 218 in the inside lever 10. The pinion member 210 further includes a head portion 220 which is contained within the boss 221 of the inside cover 78. The cover 78 is attached to the housing 172 by means of screws 222 which are threadedly engaged with the housing 172. The head portion 220 of the pinion member 210 also includes a slot 224 through which one end of the spindle 58 extends.

Figure 15:
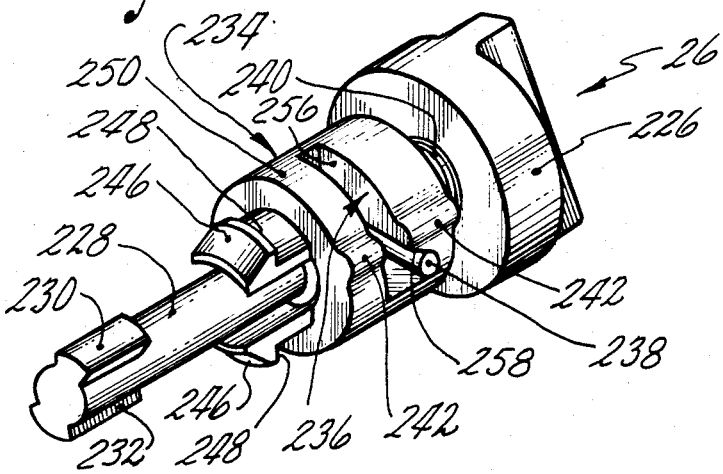
FIG. 15 is a perspective view of the thumb piece assembly used in connection with the inside operating assembly of the lockset.

Referring to FIGS. 2 and 15, the turn button 26 includes a knob 226 having a rod 228 extending inwardly therefrom. The end of the rod 228 includes two opposed radial extending ear portions 230 and 232 for engaging the opposed ribs 214 and 216 in the tubular extension 212 of the inside pinion member 210. A cam member 234 is mounted on the rod 228 having a cam slot 236 therein. A cam follower 238 in the form of a roll pin extends radially out from the rod into the cam slot 236. A spring 240 is provided between the cam member 234 and the knob 226 to bias the knob 226 outwardly.

The cam member 234 includes a bump 242 on its circumference which mates with an indention 244 in the opening 218 in the inside lever 10 to prevent rotation of the cam member 234 with respect to the lever 10. The cam member 234 also includes inwardly projecting tongues 246 having shoulders 248 thereon. The turn button 26 is mounted in the opening 218 of the inside lever 10 with the body 250 of the cam member 234 engaging an outwardly facing shoulder 252 in the lever 8 and the shoulder 248 on the tongues 246 engaging an inwardly facing shoulder 254 in the lever 10. When mounted in the lever 10, the rod 228 extends into the pinion member 210 of the inside operating assembly.

The cam slot 236 extends partially around the circumference of the body 250 of the cam member and includes a generally straight portion 256 and an outwardly extending detent portion 258 which acts as a detent for the cam follower 238. When the knob 226 is rotated from its locked position to its unlocked position, the cam follower 238 will reach the outwardly extending detent portion 258. At this point, the knob 226 and rod 228 will move outwardly under the force of the spring 240, releasably holding the knob 226 in the unlocked position.

Figure 16:
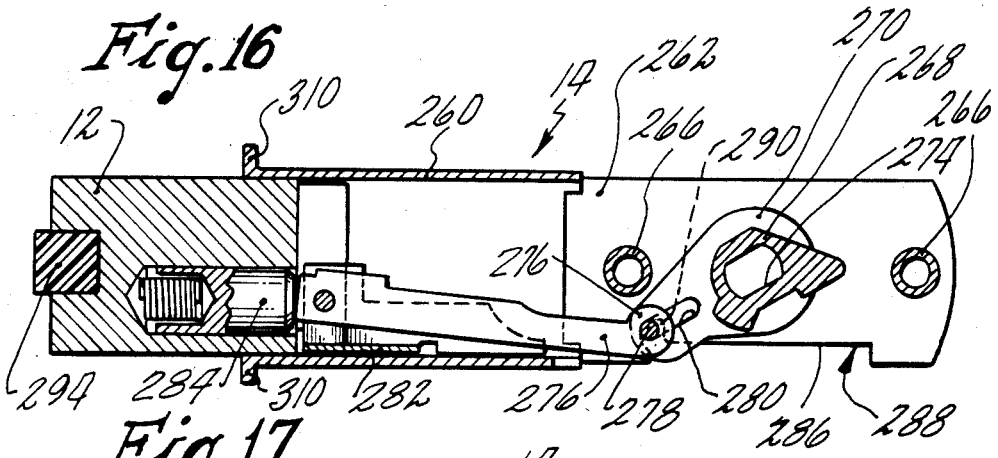
FIG. 16 is a vertical sectional view taken along the lines 16—16 of FIG. 3 and showing the cross-section of the latch bolt assembly with the latch bolt in its dead bolt or fully extended position.
Figure 17:
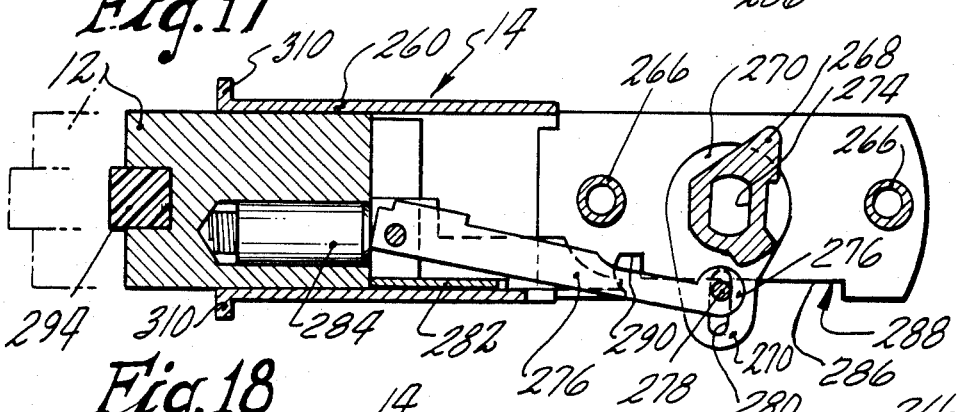
FIG. 17 is a view similar to that of FIG. 16 but showing the latch bolt in its latching position.
Figure 18:
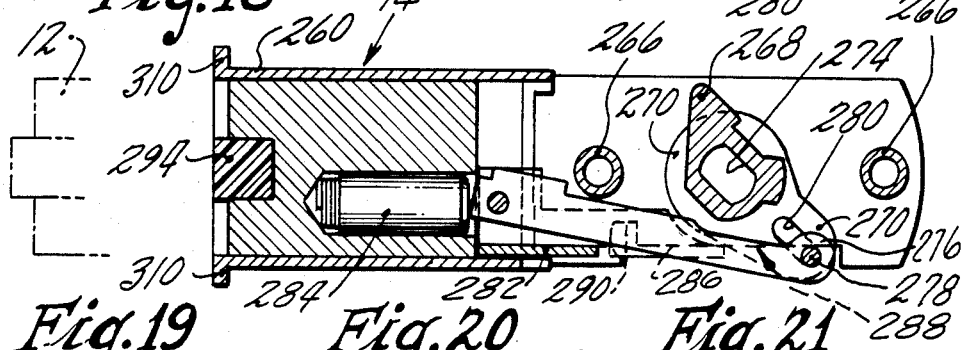
FIG. 18 is a view similar to that of FIG. 16 but showing the latch bolt in its open or fully retracted position.
Figure 19:
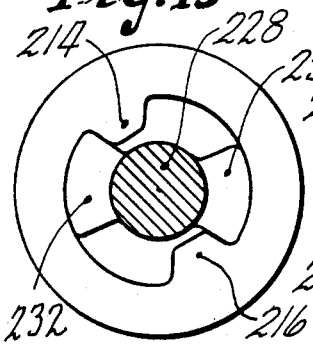
FIG. 19 is a view taken along the lines 19—19 of FIG. 2 and showing the relationship of the turn button actuator with respect to the pinion extension when the latch bolt is in its dead bolt position.

Referring to FIGS. 2 and 16–18, the latch bolt 12 of the latch bolt assembly 14 is shown movable between an extended position in FIG. 16, a latching position in FIG. 17 and an open position in FIG. 18. The latch bolt assembly 14 includes a latch case 260 having two spaced latch plates 262 and 264 (FIG. 2) extending rearwardly therefrom. The latch plates 262 and 264 are held mounted together by means of bushings 266. The latch bolt assembly 14 is mounted within the slot 43 in the latch bolt assembly holder 42 with the screw 64 which attaches the latch bolt assembly 14 to the latch bolt assembly holder 42 extending through the rearward one of the bushings 266.

A hub member 268 upon which two lever plates 270 are mounted for rotation therewith is mounted between the two latch plates 262 and 264 in suitable openings 272 therein. The hub member 268 has a generally rectangular bore 274 therethrough of a shape to receive the spindle 58. The bolt 12 is mounted within the latch case 260 and has an arm 276 extending rearwardly therefrom toward the lever plates 270. The arm 276 is pivotably attached at its forward end to the bolt 12 and at its rearward end has a pivot pin 278 extending through an elongated slot 280 in the lever plate 270. A guide 282 having opposed side walls in which the arm 276 is positioned is also pivotally attached to the rearward end of the bolt. A spring biased dowel 284 is mounted in the bolt head and has its end face engaging one corner on the forward portion of the arm 276. This serves to bias the arm 276 in a direction such that the pivot pin 278 will engage the edge 286 of the latch plates 262 and 264 in a cutout portion 288. At the forward end of the cutout portion 288 there is a deeper cutout portion 290 forming a detent into which the pivot pin 278 is moved when the latch bolt 12 is moved into its extended dead bolt position.

Figure 25:
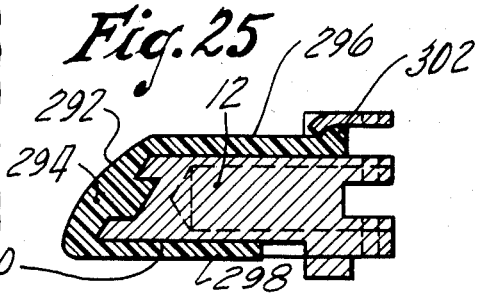
FIG. 25 is a horizontal cross-sectional view through the tip of the latch bolt assembly.

The latch bolt 12 includes a beveled forward portion 292 in a manner known in the art. The latch bolt 12 also includes a wear strip 294 of suitable wear resistance material (see FIG. 25) of the type mentioned in connection with the wear pads 165 which extends about the exposed portions of the latch bolt 12 thereof including the beveled forward portion 292 as well as the front and rear sides 296 and 298.

The wear strip 294 is mounted in a groove 300 in the latch bolt 12 and includes at the end of its front side a raised portion 302 which extends into the body of the latch bolt 12 and which is staked thereover. The spindle 58 extends between the two pinions 150 and 210 and through the hub member 268 of the latch bolt assembly 14.

Figure 7:
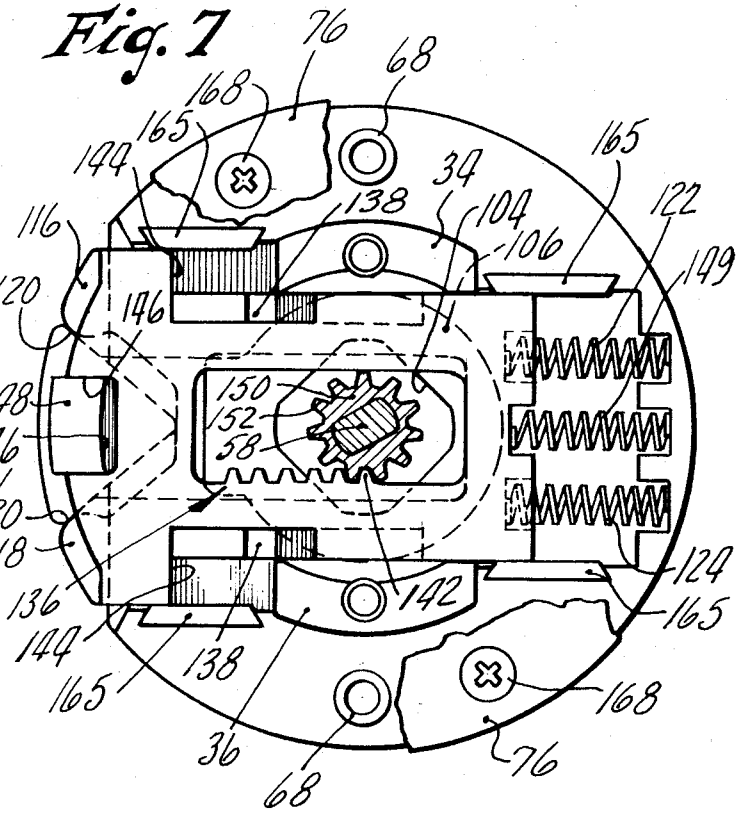
FIG. 7 is a view taken along the lines 7—7 of FIG. 2 with the rose removed showing the position of the elements of the outside operating cassette when the lockset is in its deadbolt position.
Figure 8:
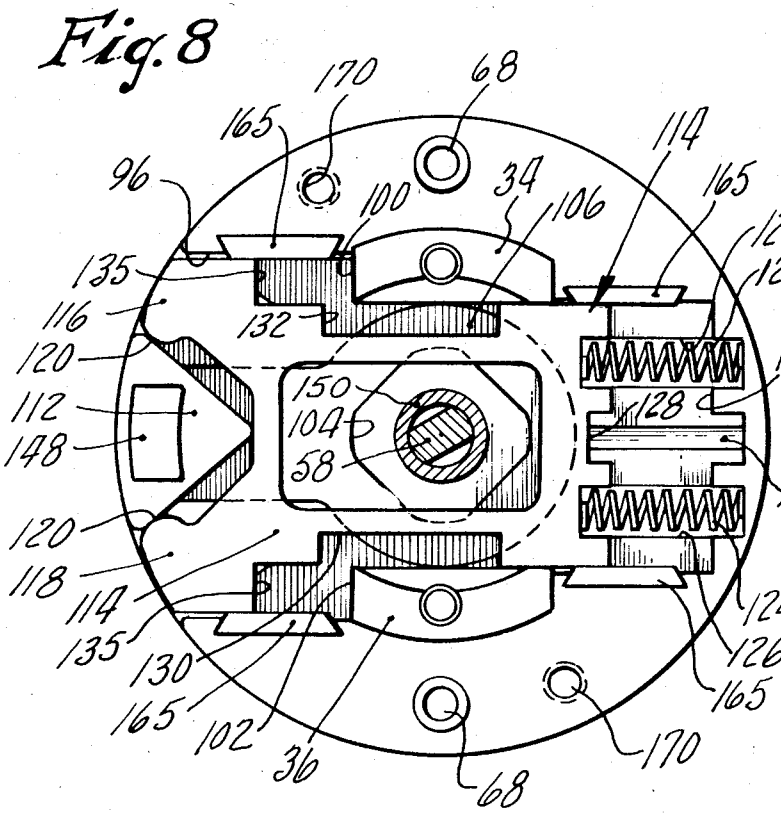
FIG. 8 is a view similar to that of FIG. 7 but showing the outside cassette with the rack plate removed.

In operation, when the latch bolt 12 is in its extended, dead bolt functioning position with the latch bolt extended, the position of the various components of the outer operating cassette 32 are shown in FIGS. 7 and 8 and the position of the various components of the inside operating cassette 52 is shown in FIG. 11. The spring plate 114 is urged radially forward in the housing 84 into engagement with the inner tip of the cam portion 112 of the actuating member 102. Likewise the spring 149 urges the rack plate 136 radially forward so that the tab portions 138 thereon engages the tab engaging surfaces 132 on the spring plate 114. The lug portion 148 on the actuating member 102 is positioned in the notch 146 in the rack plate 136. This arrangement prevents the outside lever 8 from being turned since the actuating member 102 cannot be rotated. The components of the inside operating cassette 52 are in substantially the same position as the outside components with the spring plate 182 biased forwardly in the housing 172 by the springs 186 against the cam surface 180 on the actuating member 174. The rack plate 196 is spring biased outwardly until its tabs 206 abut the tab engaging portions 190 on the spring plate 182. In the case of the inside operating cassette however, the rack plate 196 does not engage the lug portion 208 on the actuating member 174 and there is no blocking engagement thereof. Thus, the inside lever 10 is free to turn enabling the latch bolt 12 to be retracted. Upon rotating the inside lever 10, the actuating member 174 pivots about the axis of the spindle 58 and the cam surfaces 180 thereof engages the cam surfaces 183 on the end of the spring plate 182 causing the spring plate 182 to move rearwardly in a linear direction. Due to the engagement of the tab engaging surface 190 on the spring plate 182 with the tabs 206 on the rack plate 196, the rack plate 196 will also be moved rearwardly in a linear direction. The rearward movement of the rack plate 196 causes the pinion member 210 to rotate thereby rotating the spindle 58 and the hub member 268 of the latch bolt assembly 14 causing complete retraction of the latch bolt 12. When the operator releases the lever 10, the spring plate 182 will move forward under the force of its associated springs 186 and the cam surfaces 183 will engage the cam surface 180 of the actuating member 134 moving the actuating member into its central position and thereby returning the lever 10 to its horizontal position and maintaining the lever 10 in that position. However, the spindle 58 and latch bolt 12 will return to its partially extended latching position wherein it is held there by means of the connection of the turn button 26 with the pinion member 210 in a manner to be explained below. It is to be noted that since the pinions are directly linked by the spindle 58, rotation of one pinion will cause the rotation of the other with the result that the two rack plates always move together. However, the two spring plates are independently operated by their respective levers.

Figure 9:
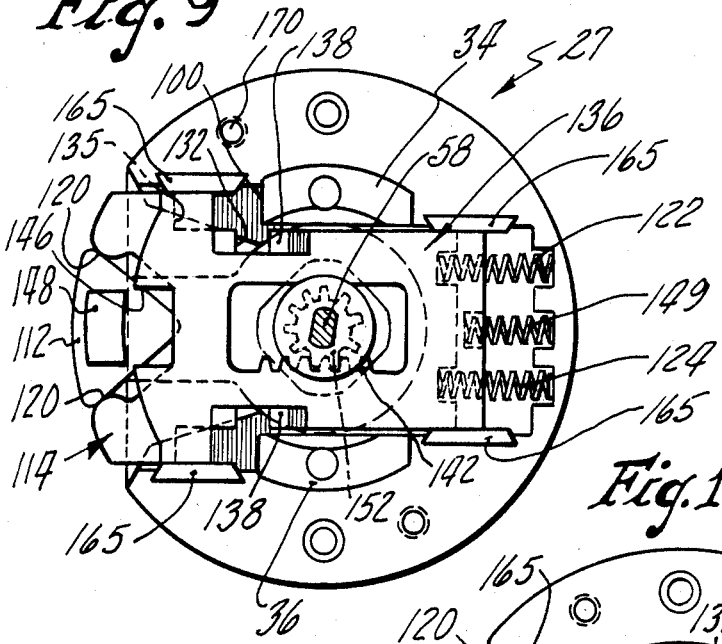
FIG. 9 is a view similar to FIG. 7 but showing the position of the components of the outside operating cassette when the latch bolt is in the latching position.
Figure 10:
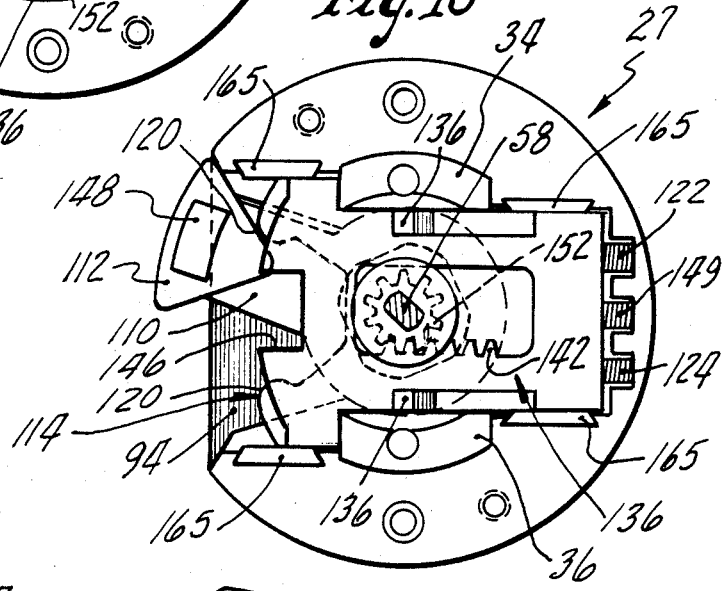
FIG. 10 is a view similar to that of FIG. 7 but showing the position of the components of the outside operating cassette when the latch bolt has been retracted into its open or retracted position by the hand operated mechanism.

When the latch bolt 12 is in its latching or partially extended position, the components of the outer operating cassette 32 are positioned as shown in FIG. 9. In this case, the spring plate 114 is forced by its associated springs 122, 124 into its forward position wherein the cam surfaces 120 abut the cam surface 112 on the actuating member 106 and maintains the actuating member 106 in its central position in the guideway 94 and the outside lever 8 horizontal. The spring plate 182 and actuator 174 in the inside cassette 52 are similarly positioned.

Figure 20:
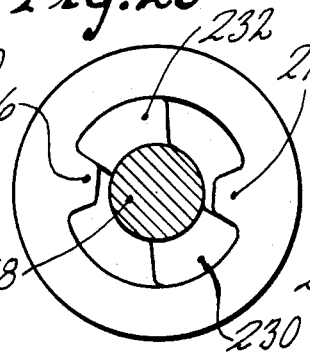
FIG. 20 is a view similar to FIG. 19 but showing the relative position of the turn button actuator with respect to the pinion extension when the latch bolt is positioned in its latching position.
Figure 21:
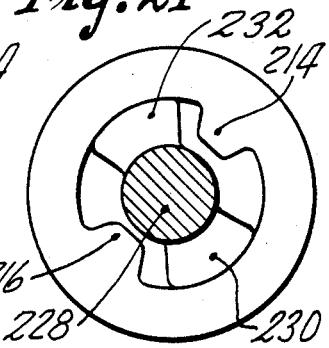
FIG. 21 is a view similar to FIG. 19 but showing the relative position of the turn button actuator with respect to the pinion extension when the latch bolt is in its fully retracted or open position.

The rack plates 136 and 196 are held in the intermediate or latching position by means of the inside pinion member 210 being held from rotation into its dead bolt position by means of the ribs in the extension portion engaging the ear portions 230, 232 on the rod of the turn button as shown in FIG. 20 when the turn button 26 is in its unlocked position with the cam follower 238 positioned in the detent portion 258 of the cam slot 236. It is to be noted that the movement of the rack plates 136 and 196 from their open to their intermediate positions under the influence of their springs 149 and 204, serve to move the latch bolt from its retracted position to its intermediate position. This eliminates the need for a spring in the latch bolt assembly 14.

Due to the lost motion connection between the turn button 26 and pinion member 210, the pinion member 210 is able to rotate from its latching position to its open position relative to the turn button thereby permitting the latch bolt 12 to be retracted when the door closes.

The turn button 26 and lock member 22 are connected to their respective pinion members 210 and 150 to drive them from their intermediate latching position into the dead bolt position merely by turning the turn button or rotating the lock with the key. This causes the pinion 210 and 150 to rotate the spindle 58 which in turn turns the hub member 268 of the latch bolt assembly 14 which drives the latch bolt 12 forward. If the key member is turned, the connection of the ear portions 230 and 232, turn button 26 with the ribs 214, 216 of the extension portion of the inside pinion 210 causes the turn button 26 to move into its locked position wherein the cam follower 238 is moved out of the detent portion 258 in the cam surface 236 onto the straight portion 256 thereof. However, in the event of turning the thumb piece from its unlocked to locked position, there is sufficient lost motion between the driver 164 of the lock cylinder 22 and the internal ribs 162 in the pinion member 150 to permit the pinion member 150 to rotate into its dead bolt position without engaging the driver 164.

With reference to FIGS. 1, 2, 23 and 24, the lockset of the present invention includes a latch front 304 which is adaptable for both a beveled door and a straight front door. In this connection, the latch front 304 has enlarged recesses 306 on its inside surface 308 to accommodate the tabs 310 of the casing of the lock bolt assembly 14. The latch front 304 is held in the door by means of screw members 312 and includes an opening 314 therein through which the latch bolt 12 extends. The opening 314 of the front 304 is beveled outwardly on both sides 3° with a flat in the middle.

While reference has been made above to a specific embodiment, it will be apparent to those skilled in the art that various modifications and alterations may be made thereto without departing from the spirit of the present invention. Therefore, it is intended that the scope of this invention be ascertained by reference to the following claims.

What is claimed is:

1. A lockset for a door comprising a latch bolt assembly including a bolt movable between a partially extended latching position, a fully extended dead bolt position, and a retracted position, a spindle extending through said latch assembly in a direction transverse of the direction of movement of said bolt, means connecting said spindle to said bolt for moving said bolt between its positions upon rotation of said spindle, and an operating assembly comprising a hand operator having locking means therein, a first plate mounted for linear movement in a direction transverse to the axis of said spindle, an actuating member connected to said hand operator for moving said first plate, a second plate having linear movement transverse to the axis of said spindle and adapted to be moved by said first plate, and rotatable drive means attached to said spindle and adapted to be rotated by said second plate.

2. The lockset of claim 1 wherein said second plate has gear teeth thereon and said rotatable drive means includes a pinion in engagement with said gear teeth.

3. The lockset of claim 1 wherein said locking means rotates said rotatable drive means.

4. The lockset of claim 1 wherein said first plate includes a cam surface and said actuating member is pivotably mounted and includes a cam surface for engaging said cam surface on said first plate to move said first plate linearly when said actuating member is pivoted.

5. The lockset of claim 4 wherein said hand operator is a lever member and means are provided for biasing said first plate to move said actuating member to a position in which the lever is horizontal.

6. The lockset of claim 1 in which said second plate is movable between a bolt open position, a bolt partially extended position, and a bolt fully extended position, and spring means bias said second plate from its bolt open position to the bolt partially extended position to the bolt fully extended position.

7. The lockset of claim 6 wherein said drive means is rotatable in one direction from a bolt open position to a bolt partially extended position to a bolt fully extended position, and further including means for preventing said drive means from rotating from its partially extended position to its fully extended position when the locking means is unlocked but permitting said drive means to be rotated in the other direction from its partially extending position to its bolt open position.

8. The lockset of claim 7 wherein said locking means is a turn button mounted in said hand operator for movement between an unlocked position and a locked position, and said means for preventing includes means interconnecting said turn button and said drive means.

9. A lockset for a door comprising a latch bolt assembly including a bolt movable between a partially extended latching position, a fully extended dead bolt position, and a retracted position, a spindle extending through said latch assembly in a direction transverse of the direction of movement of said bolt, means connecting said spindle to said bolt for moving said bolt between its positions upon rotation of said spindle, an inside operating assembly comprising an inside hand operator having inside locking means therein, an inside first plate mounted for linear movement in a direction transverse to the axis of said spindle, an inside actuating member connected to said inside hand operator for moving said inside first plate, an inside second plate having linear movement transverse to the axis of said spindle and adapted to be moved by said first plate, and inside rotatable drive means attached to said spindle and adapted to be rotated by said second plate, and an outside operating assembly including an outside hand operator having outside locking means therein, an outside first plate mounted for linear movement in a direction transverse to the axis of said spindle, an outside actuating member connected to said inside hand operator for moving said outside first plate, an outside second plate having linear movement transverse to the axis of said spindle and adapted to be moved by said outside first plate, and outside rotatable drive means attached to said spindle and adapted to be rotated by said second plate.

10. The lockset of claim 9 wherein said inside and outside second plates have gear teeth thereon and each of said inside and outside rotatable drive means includes a pinion in engagement with said gear teeth on its respective second plate.

11. The lockset of claim 9 wherein each of said inside and outside locking means rotates its respective rotatable drive means.

12. The lockset of claim 9 wherein said inside and outside first plate each includes a cam surface and each of said inside and outside actuating members is pivotably mounted and includes a cam surface for engaging said cam surface on its respective first plate to move said first plate linearly when said actuating member is pivoted.

13. The lockset of claim 12 wherein said inside and outside hand operators are a lever member and means are provided with both first plate for biasing said first plate to move said actuating member to a position in which the lever is horizontal.

14. The lockset of claim 9 in which each of said second plates is movable between a bolt open position, a bolt partially extended position, and a bolt fully extended position, and spring means bias said each of second plates from its bolt open position to the bolt partially extended position to said bolt fully extended position.

15. The lockset of claim 14 wherein said inside drive means is rotatable in one direction from a bolt open position to a bolt partially extended position to a bolt fully extended position, and further including means for preventing said inside drive means from rotating from its partially extended position to its fully extended position when either of the locking means is unlocked but permitting said inside drive means to be rotated in the other direction from its partially extending position to its bolt open position.

16. The lockset of claim 15 wherein said inside locking means is a turn button mounted in said inside hand operator for movement between a unlocked position and a locked position, and said means for preventing includes means interconnecting said turn button and said inside drive means.

17. The lockset of claim 9 further including means preventing pivoting of the outside actuating member when said second plate is in its bolt fully extended position.

18. The lockset of claim 17 in which said means preventing pivoting includes a lug extending inwardly from said outside actuating member and said outside second plate has a notch in its end portion engagable with said lug when said second plate is in its bolt fully extended position.

* * * * *